United States Patent [19]

Bennett

[11] Patent Number: 4,809,145

[45] Date of Patent: Feb. 28, 1989

[54] FREE-STANDING (SELF-SUPPORTING) LAMP SHADE

[76] Inventor: Martin B. Bennett, 645 East 26th St., Brooklyn, N.Y. 11210

[21] Appl. No.: 5,605

[22] Filed: Jan. 21, 1987

[51] Int. Cl.[4] ..... F21V 1/04

[52] U.S. Cl. ..... 362/358

[58] Field of Search ..... 362/351, 358, 359, 361, 362/357, 355

[56] References Cited

U.S. PATENT DOCUMENTS

| | | | |
|---|---|---|---|
| 1,709,951 | 4/1929 | Richardson | 362/358 |
| 2,224,950 | 12/1940 | Burke | 362/358 |
| 2,332,470 | 10/1943 | Richards | 362/351 |
| 2,878,371 | 3/1959 | Hanlin | 362/351 |
| 4,328,535 | 5/1982 | Cornell | 362/396 |
| 4,366,407 | 12/1982 | Walsh | 362/255 |

*Primary Examiner*—Charles J. Myhre
*Assistant Examiner*—David A. Okonsky

[57] ABSTRACT

A device for controlling the illumination within a room without touching the light or its power source. This device includes the use of a shade which blocks the light emitted.

4 Claims, 1 Drawing Sheet

FREE-STANDING (SELF-SUPPORTING) LAMP SHADE

BACKGROUND OF THE INVENTION

1. Field of the Invention

This invention involves a device for controlling the illumination in a room, at will, without touching the light or its power source. The device is intended to overcome religious prohibitions observed during the Sabbath under Orthodox Jewish law.

2. Description of Prior Art

The only modern device to permit the control of illumination under these circumstances is the (electric) timer. However, the timer must be set up prior to the Sabbath and can not be changed during that day without violating religious prohibitions.

SUMMARY OF THE INVENTION

This invention relates to a device for interrupting the flow of light from a light source (lamp) into a space or room, which would otherwise by illuminated by the lamp. The device is portable and may be removed from the lamp at will. It is essentially an opaque to translucent shade, which covers the light—but does not directly touch any part of the lamp or any of its associated electrical parts.

The device may be in any geometrical shape or combination of geometrical shapes. It may consist of one part or more than one part. It can be stiff, flexible or made to unfold or roll up. The essential feature is that it interrupts the flow of light from the source to the room, at the operator's will, without touching the lamp or its associated electrical parts.

DESCRIPTION OF THE PREFERRED EMBODIMENT

Figure 1:
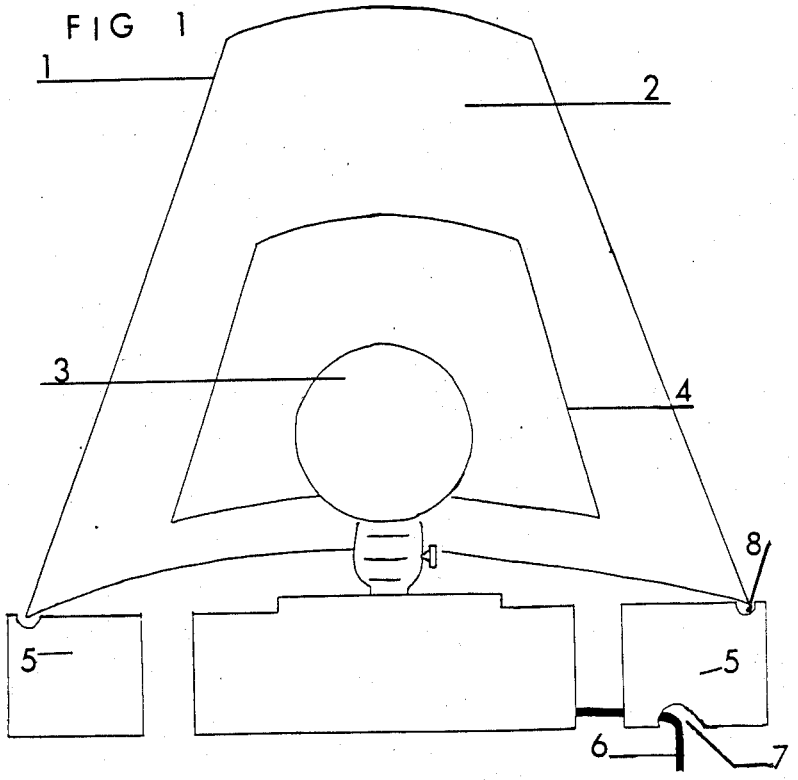
FIG. 1 illustrates the device as used.

FIG. 1 illustrates the device (1) when used to block a lamp's light. The shade (2) fits over the lamp bulb (or light source) (3) and lamp base. The shade fits into the slots (8) in a shade base (5). The electric cord (6) exits from the lamp through a slot (7) in the shade base. The lamp may have an ordinary shade between the bulb and the opaque shade.

Figure 2:
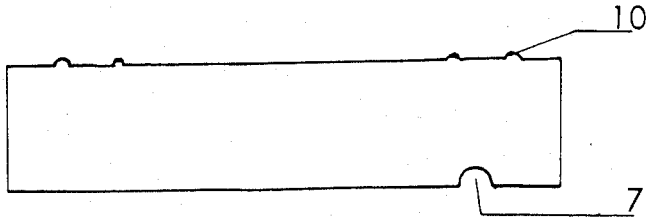
FIG. 2 is a base suitable for placement under the shade.

FIG. 2 illustrates the shade base. In this case raised projections (10) are used to position the shade. The cord exits through the slot (7).

Figure 3:
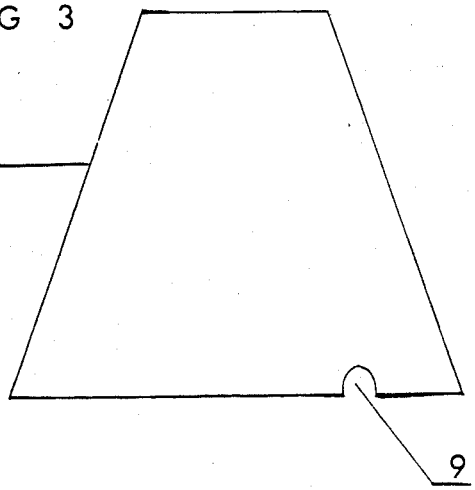
FIG. 3 is a shade suitable for use with the lamp.

FIG. 3 illustrates a shade, which can be used without the shade base. In this case the wire exits through a slot (9).

Figure 4:
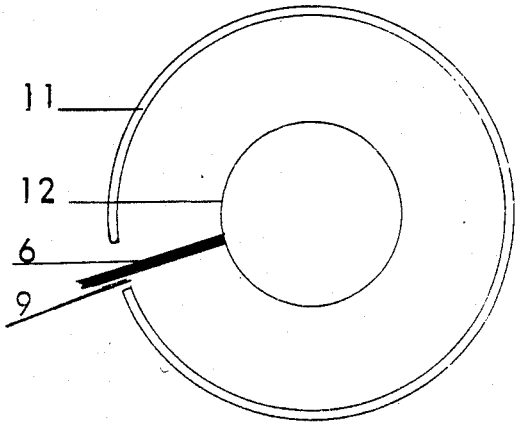
FIG. 4 is a view of the bottom as seen from the surface of the table.

The embodiment of FIG. 4 shows the device (11) surrounds the light source (12). The electric cord (6) passes through a slot (9).

The simplest device is an opaque shade, which appears like an inverted flower pot, with a small portion of the rim chipped away for the electric cord to pass through.

The device's design may vary. The light may be powered by line voltage, or by battery, it may be fueled by gas or hydrocarbons, or even a candle. The shade may be solid or flexible or may even roll down like a window shade or horizontally. It may have removable parts in any shape or combination thereof, such as: cone, sphere, hemisphere, pyramid, diamond, cube, rectangle, or disc.

The device may have a fabric covering placed over a preset frame, or it may have slats or other removable parts, w;hich can be removed or turned so as to cut off light. It may be made of any suitable material such as plastic, wood, metal ceramic, rubber, opaque glass, cloth, etc. However, materials that do not conduct electricity and do not pose a fire or heat build up hazard are preferred.

The device may have holes for ventilation, to cool off internal parts and to permit the passage of the electric wire.

For larger lamps a teepee like or similar device may be more appropriate.

I claim:

1. An assembly for controlling light transmitted from a means of illumination including shade means;

said means of illumination comprising light source means and support means; said support means including a base portion for rest on a planar surface;

said shade means enclosing said means of illumination wherein said shade means is entirely free from connection with said means of illumination, said shade means having means for the escape of heat and a separate means of support so as to apply no load to said support means of said means of illumination.

2. An assembly for controlling light in accordance with claim 1 wherein said means of illumination includes a light modifier means, said shade means being free from connection with light modifier means.

3. An assembly for controlling light in accordance with claim 2 wherein said light modifier means comprises a shade means.

4. An assembly for controlling light in accordance with claim 1 wherein said means of illumination includes a connection means and wherein said shade means has an opening allowing for contact free passage of said connection means.

* * * * *